US011199198B2

(12) United States Patent
Bessho

(10) Patent No.: US 11,199,198 B2
(45) Date of Patent: Dec. 14, 2021

(54) CENTRIFUGAL COMPRESSOR

(71) Applicant: IHI Corporation, Tokyo (JP)

(72) Inventor: Yasutaka Bessho, Tokyo (JP)

(73) Assignee: IHI Corporation, Tokyo (JP)

( * ) Notice: Subject to any disclaimer, the term of this patent is extended or adjusted under 35 U.S.C. 154(b) by 0 days.

(21) Appl. No.: 17/093,866

(22) Filed: Nov. 10, 2020

(65) Prior Publication Data

US 2021/0054853 A1 Feb. 25, 2021

Related U.S. Application Data

(63) Continuation of application No. PCT/JP2019/031009, filed on Aug. 6, 2019.

(30) Foreign Application Priority Data

Aug. 23, 2018 (JP) ..... JP2018-156431

(51) Int. Cl.
*F03B 11/04* (2006.01)
*F04D 29/44* (2006.01)
(Continued)

(52) U.S. Cl.
CPC ..... *F04D 29/441* (2013.01); *F04D 17/10* (2013.01); *F04D 29/284* (2013.01); *F05D 2220/40* (2013.01)

(58) Field of Classification Search
CPC . F04D 9/005; F04D 29/24; F01D 9/02; F05B 2240/12
(Continued)

(56) References Cited

U.S. PATENT DOCUMENTS 2,660,366 A * 11/1953 Klein ..... F04D 27/0215 415/58.4
3,846,039 A * 11/1974 Stalker ..... F04D 29/541 415/206
(Continued)

FOREIGN PATENT DOCUMENTS

CN 105351240 A 2/2016
CN 105378293 A 3/2016
(Continued)

OTHER PUBLICATIONS

International Search Report dated Oct. 29, 2019 in PCT/JP2019/031009 filed Aug. 6, 2019 (with English translation), citing documents AA and AP-AQ therein, 2 pages.
(Continued)

*Primary Examiner* — John Kwon
(74) *Attorney, Agent, or Firm* — Oblon, McClelland, Maier & Neustadt, L.L.P.

(57) ABSTRACT

A centrifugal compressor includes: an upstream side squeeze portion having a flow passage cross-sectional area that decreases as the upstream side squeeze portion extends closer to a compressor impeller; a partition wall facing the inner circumferential surface of the upstream side squeeze portion and arranged with a gap from the inner circumferential surface of the upstream side squeeze portion; and a protrusion protruding from at least one of the inner circumferential surface of the upstream side squeeze portion or the outer circumferential surface of the partition wall.

17 Claims, 5 Drawing Sheets

(51) Int. Cl.
*F04D 17/10* (2006.01)
*F04D 29/28* (2006.01)

(58) Field of Classification Search
USPC ..... 415/56.5, 58.4, 191, 206
See application file for complete search history.

(56) References Cited

U.S. PATENT DOCUMENTS

2004/0009061 A1 1/2004 McDonald
2004/0234373 A1* 11/2004 Martin ..... F01D 9/026 415/206
2009/0214334 A1 8/2009 Fukami
2009/0263234 A1 10/2009 Yin
2012/0121400 A1* 5/2012 Tomita ..... F04D 27/0238 415/206
2014/0093364 A1* 4/2014 Narehood ..... F01D 17/165 415/191
2015/0354591 A1 12/2015 Ibaraki et al.
2016/0017791 A1 1/2016 Nakao
2016/0076553 A1* 3/2016 Bessho ..... F04D 25/024 415/204
2016/0201693 A1* 7/2016 An ..... F04D 29/4213 415/58.4
2018/0094647 A1 4/2018 Puzik et al.

FOREIGN PATENT DOCUMENTS

JP 2004-44576 A 2/2004
JP 2004-144029 A 5/2004
JP 2005-23792 A 1/2005
JP 2008-208753 A 9/2008
JP 2010-270641 A 12/2010
JP 2012-177311 A 9/2012
JP 5824821 B2 12/2015
JP 2017-20514 A 1/2017
JP 2018-513302 A 5/2018
WO WO 2014/128931 A1 8/2014

OTHER PUBLICATIONS

Chinese Office Action issued in Chinese Patent Application No. 201980033204.6 dated Sep. 3, 2021.

* cited by examiner

CENTRIFUGAL COMPRESSOR

CROSS REFERENCE TO RELATED APPLICATIONS

This application is a continuation application of International Application No. PCT/JP2019/031009, filed on Aug. 6, 2019, which claims priority to Japanese Patent Application No. 2018-156431, filed on Aug. 23, 2018, the entire contents of which are incorporated by reference herein.

BACKGROUND ART

Technical Field

The present disclosure relates to centrifugal compressors.

Related Art

A turbocharger includes a compressor. A compressor includes a compressor housing and a compressor impeller. An intake passage for guiding the air (intake air) to the compressor impeller is formed in the compressor housing. A shroud portion is formed in the compressor housing on the outer circumferential side of the compressor impeller. In Patent Literature 1, an annular air chamber is formed in the shroud portion. In the shroud portion, a suction communication passage and a discharge communication passage that connects the intake passage and the air chamber are formed. The suction communication passage is formed on the outer diameter side of the compressor impeller. The discharge communication passage is formed on the upstream side of the intake passage with respect to the compressor impeller. The suction communication passage, the air chamber, and the discharge communication passage form a circulation flow passage. The circulation flow passage expands the working range of the turbocharger, in the smaller flow rate area.

CITATION LIST

Patent Literatures

Patent Literature 1: Japanese Patent No. 5824821

SUMMARY

Technical Problem

However, in a case where the circulation flow passage is formed, the working range of the turbocharger in the larger flow rate area is reduced. Therefore, in Patent Literature 1, it is difficult to expand the working range of the turbocharger.

An object of the present disclosure is to provide a centrifugal compressor capable of expanding the working range of a turbocharger.

Solution to Problem

In order to solve the above problem, a centrifugal compressor according to an aspect of the present disclosure includes: a compressor impeller; a main flow passage formed on a front side of the compressor impeller; a squeeze portion provided in the main flow passage, the squeeze portion having a flow passage cross-sectional area that decreases as the squeeze portion extends closer to the compressor impeller; a partition wall facing an inner circumferential surface of the squeeze portion and arranged with a gap from the inner circumferential surface of the squeeze portion; and a protrusion protruding from at least one of the inner circumferential surface of the squeeze portion or an outer circumferential surface of the partition wall.

The protrusion may include portions that are spaced apart from each other and face each other in an axial direction of the compressor impeller.

The protrusion may extend for one or more rounds in a rotation direction of the compressor impeller.

The protrusion may include portions spaced apart from each other and facing each other in an axial direction of the compressor impeller, and an interval of the protrusion between a portion farthest from the compressor impeller and a portion facing thereto in the axial direction may be larger than an interval of the protrusion between a portion closest to the compressor impeller and a portion facing thereto in the axial direction.

An interval between the inner circumferential surface of the squeeze portion and the outer circumferential surface of the partition wall may be larger on a side spaced apart from the compressor impeller than on a side closer to the compressor impeller.

The centrifugal compressor may include a second squeeze portion provided in the main flow passage, positioned closer to the compressor impeller than the squeeze portion, and has an inner circumferential surface protruding inward in a radial direction of the compressor impeller with respect to an inner circumferential surface of the partition wall.

Effects of Disclosure

According to the present disclosure, a working range of a turbocharger can be expanded.

DESCRIPTION OF EMBODIMENTS

Embodiments of the present disclosure will be described in detail below with reference to the accompanying drawings. Dimensions, materials, specific numerical values, and the like illustrated in embodiments are merely examples for facilitating understanding, and the present disclosure is not limited thereby except for a case where it is specifically mentioned. Note that, in the present specification and the drawings, components having substantially the same function and structure are denoted by the same symbol, and redundant explanations are omitted. Components not directly related to the present disclosure are not illustrated.

Figure 1:
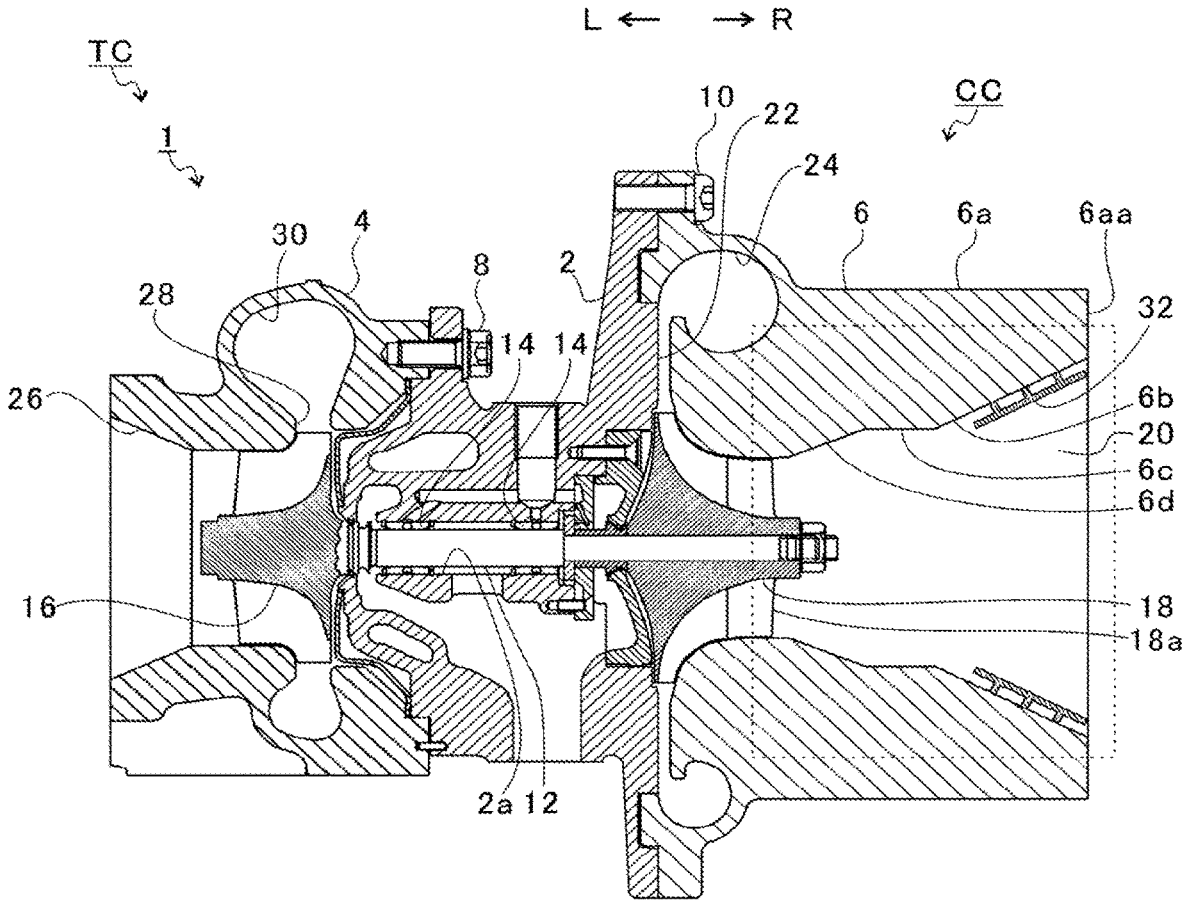
FIG. 1 is a schematic cross-sectional view of a turbocharger.

FIG. 1 is a schematic cross-sectional view of a turbocharger TC. Hereinafter, description is given assuming that a direction of an arrow L illustrated in FIG. 1 is the left side of the turbocharger TC. Description is given assuming that a direction of an arrow R illustrated in FIG. 1 is the right side of the turbocharger TC. In the turbocharger TC, a compressor housing 6 side described later functions as a centrifugal compressor CC. Hereinafter, the turbocharger TC is described as an example of the centrifugal compressor CC. However, the centrifugal compressor CC is not limited to the turbocharger TC. The centrifugal compressor CC may be incorporated in a device other than the turbocharger TC or may be a separate device.

As illustrated in FIG. 1, the turbocharger TC includes a turbocharger main body 1. The turbocharger main body 1 includes a bearing housing 2, a turbine housing 4, and a compressor housing 6. The turbine housing 4 is connected to the left side of the bearing housing 2 by a fastening bolt 8. The compressor housing 6 is connected to the right side of the bearing housing 2 by a fastening bolt 10.

A bearing hole 2*a* is formed in the bearing housing 2. The bearing hole 2*a* penetrates in the left-right direction of the turbocharger TC. The bearing hole 2*a* accommodates a part of a shaft 12. Bearings 14 are accommodated in the bearing hole 2*a*. In FIG. 1, a full-floating bearing is illustrated as an example of the bearings 14. However, the bearings 14 may be another radial bearing such as a semi-floating bearing or a rolling bearing. The shaft 12 is rotatably supported by the bearings 14. At the left end of the shaft 12, a turbine Impeller 16 is provided. The turbine impeller 16 is rotatably accommodated in the turbine housing 4. At the right end of the shaft 12, a compressor impeller 18 is provided. The compressor impeller 18 is rotatably accommodated in the compressor housing 6.

A main flow passage 20 is formed in the compressor housing 6. The main flow passage 20 opens to the right side of the turbocharger TC. The main flow passage 20 is formed on the upstream side (front side) of the compressor impeller 18. The main flow passage 20 extends in the rotation axis direction of the compressor impeller 18 (hereinafter simply referred to as the axial direction). The main flow passage 20 is connected to an air cleaner (not illustrated). The compressor impeller 18 is arranged in the main flow passage 20. The centrifugal compressor CC of this embodiment includes the compressor housing 6, the compressor impeller 18, and a baffle 32 described later.

The opposing surfaces of the bearing housing 2 and the compressor housing 6 form a diffuser flow passage 22. The diffuser flow passage 22 pressurizes the air. The diffuser flow passage 22 is formed in an annular shape. The diffuser flow passage 22 communicates with the main flow passage 20 via the compressor impeller 18 on the inner side in the radial direction.

A compressor scroll flow passage 24 is formed in the compressor housing 6. The compressor scroll flow passage 24 is formed in an annular shape. The compressor scroll flow passage 24 is positioned on, for example, an outer side in the radial direction of the shaft 12 with respect to the diffuser flow passage 22. The compressor scroll flow passage 24 communicates with an intake port of an engine (not illustrated) and the diffuser flow passage 22. When the compressor impeller 18 rotates, the air is sucked into the compressor housing 6. The sucked air flows in the compressor housing 6 (main flow passage 20) from the upstream side (right side in FIG. 1) to the downstream side (left side in FIG. 1). The sucked air is pressurized and accelerated in the process of flowing through blades of the compressor impeller 18. The pressurized and accelerated air is pressurized by the diffuser flow passage 22 and the compressor scroll flow passage 24. The pressurized air is guided to the intake port of the engine.

A discharge port 26 is formed in the turbine housing 4. The discharge port 26 opens to the left side of the turbocharger TC. The discharge port 26 is connected to an exhaust gas purification device (not illustrated). A communication passage 28 and a turbine scroll flow passage 30 are formed in the turbine housing 4. The turbine scroll flow passage 30 is formed in an annular shape. The turbine scroll flow passage 30 is positioned, for example, on an outer side in the radial direction of the turbine impeller 16 with respect to the communication passage 28. The turbine scroll flow passage 30 communicates with a gas inlet port (not illustrated). Exhaust gas discharged from an exhaust manifold of the engine (not illustrated) is guided to the gas inlet port. The communication passage 28 connects the turbine scroll flow passage 30 and the discharge port 26 via the turbine impeller 16. The exhaust gas guided from the gas inlet port to the turbine scroll flow passage 30 is guided to the discharge port 26 via the communication passage 28 and the turbine impeller 16. The exhaust gas guided to the discharge port 26 rotates the turbine impeller 16 in the process of flowing therethrough.

The turning force of the turbine impeller 16 is transmitted to the compressor impeller 18 via the shaft 12. When the compressor impeller 18 rotates, the air is pressurized as described above. In this manner, the air is guided to the intake port of the engine.

The compressor housing 6 includes a cylindrical portion 6*a*. The main flow passage 20 is formed on the inner circumferential surface of the cylindrical portion 6*a*. The main flow passage 20 includes an upstream side squeeze portion (first squeeze portion) 6*b*, a parallel portion 6*c*, and a downstream side squeeze portion (second squeeze portion) 6*d*. The upstream side squeeze portion 6*b* is continuous with the opening of the cylindrical portion 6*a*.

The inner diameter of the upstream side squeeze portion 6*b* decreases as the upstream side squeeze portion 6*b* extends closer the compressor impeller 18. The flow passage cross-sectional area of the upstream side squeeze portion 6*b* decreases as the upstream side squeeze portion 6*b* extends closer to the compressor impeller 18. The upstream side squeeze portion 6*b* reduces the flow passage cross-sectional area of the main flow passage 20 to a first flow passage cross-sectional area. The parallel portion 6*c* is parallel to the axial direction. The parallel portion 6*c* is continuous from the upstream side squeeze portion 6*b* to the compressor impeller 18 side. The inner diameter of the downstream side squeeze portion 6*d* decreases as the downstream side squeeze portion 6*d* extends closer the compressor impeller 18. The flow passage cross-sectional area of the downstream side squeeze portion 6*d* decreases as the downstream side squeeze portion 6*d* extends closer to the compressor impeller 18. The downstream side squeeze portion 6*d* reduces the flow passage cross-sectional area of the main flow passage 20 to a second flow passage cross-sectional area smaller than the first flow passage cross-sectional area. The downstream side squeeze portion 6*d* is continuous from the parallel portion 6*c* to the compressor impeller 18 side. The downstream side squeeze portion 6*d* is positioned closer to the compressor impeller 18 than the upstream side squeeze portion 6*b* is.

The upstream side squeeze portion 6*b*, the parallel portion 6*c*, and the downstream side squeeze portion 6*d* are arranged on the upstream side (front side) of the compressor impeller 18. A baffle attachment portion (not illustrated) is attached to an opening surface 6*aa* of the cylindrical portion 6*a*. With the baffle attachment portion (not illustrated) attached, the baffle 32 is arranged on the inner diameter side of the upstream side squeeze portion 6*b*. The baffle 32 is fastened to, for example, the opening surface 6*aa* of the cylindrical portion 6*a* by a fastening member. However, the baffle 32 may be attached to the inner circumferential surface of the upstream side squeeze portion 6*b*. For example, the baffle 32 may be attached to the inner circumferential surface of the upstream side squeeze portion 6*b* by adhesion, welding, or press-fitting.

Figure 2:
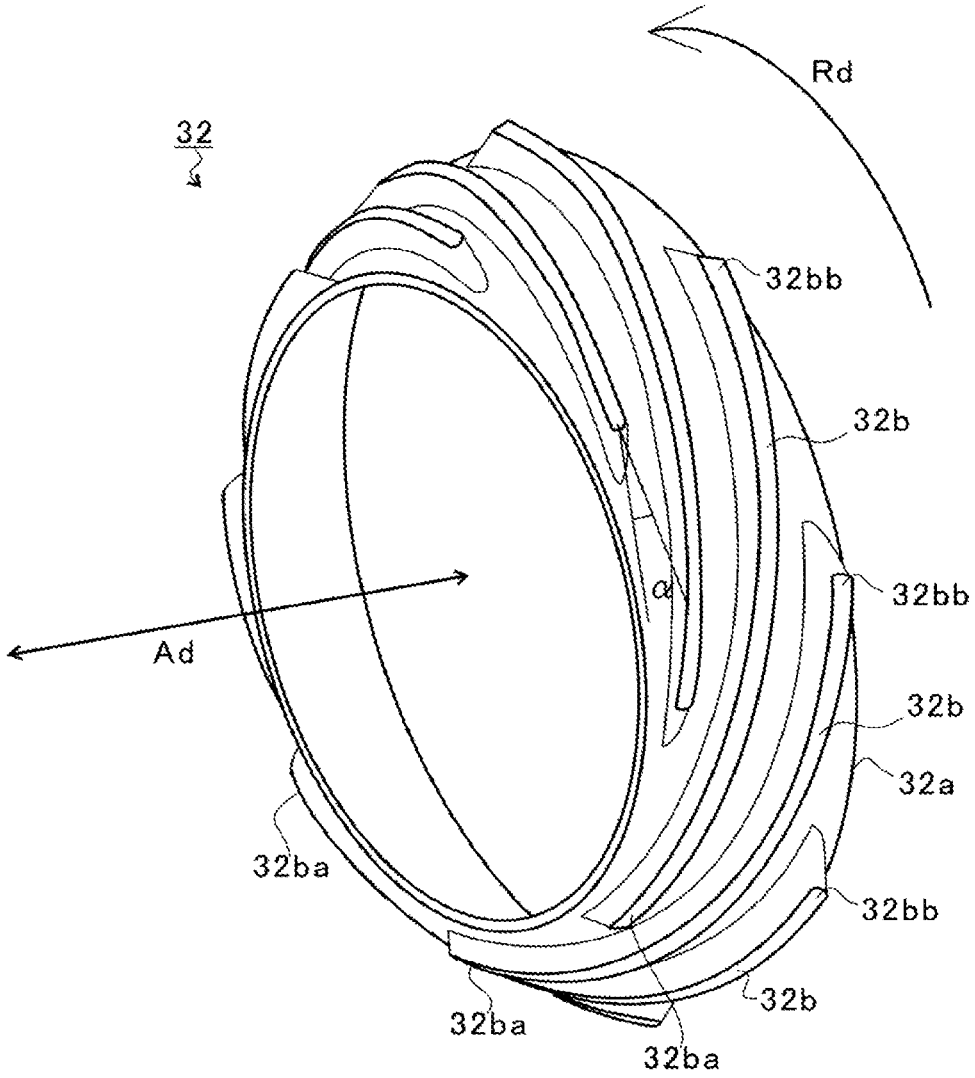
FIG. 2 is a schematic perspective view of a baffle in the present embodiment.

FIG. 2 is a schematic perspective view of the baffle 32 in the present embodiment. The baffle 32 includes a partition wall 32*a* and protrusions 32*b*. The partition wall 32*a* has a truncated cone shape. The partition wall 32*a* faces the inner circumferential surface of the upstream side squeeze portion 6*b*. The partition wall 32*a* is arranged with a gap from the inner circumferential surface of the upstream side squeeze portion 6*b*. The partition wall 32*a* has an outer circumferential surface that is parallel to the inner circumferential surface of the upstream side squeeze portion 6*b*. Therefore, the outer diameter of the partition wall 32*a* decreases as the partition wall 32*a* extends closer to the compressor impeller 18. However, the outer circumferential surface of the partition wall 32*a* may not be parallel to the inner circumferential surface of the upstream side squeeze portion 6*b*.

The partition wall 32*a* has an inner circumferential surface parallel to the inner circumferential surface of the upstream side squeeze portion 6*b*. Therefore, the inner diameter of the partition wall 32*a* decreases as the partition wall 32*a* extends closer to the compressor impeller 18. However, the inner circumferential surface of the partition wall 32*a* may not be parallel to the inner circumferential surface of the upstream side squeeze portion 6*b*.

At least one protrusion 32*b* is formed on the outer circumferential surface of the partition wall 32*a*. The protrusions 32*b* protrude from the outer circumferential surface of the partition wall 32*a* in a direction approaching the inner circumferential surface of the upstream side squeeze portion 6*b*. In the present embodiment, the protrusions 32*b* protrude in a direction perpendicular to the outer circumferential surface of the partition wall 32*a*. However, the protrusions 32*b* may not protrude in the direction perpendicular to the outer circumferential surface of the partition wall 32*a*. For example, the protrusions 32*b* may protrude from the outer circumferential surface of the partition wall 32*a* in the radial direction of the compressor impeller 18. The protrusions 32*b* are in contact with the inner circumferential surface of the upstream side squeeze portion 6*b*. However, the protrusions 32*b* may not be in contact with the inner circumferential surface of the upstream side squeeze portion 6*b*.

In the present embodiment, a plurality of protrusions 32*b* is formed spaced apart from each other in the rotation direction Rd of the compressor impeller 18 (hereinafter, simply referred to as the rotation direction). The plurality of protrusions 32*b* is formed at equal intervals in the rotation direction Rd. However, the plurality of protrusions 32*b* may be formed at unequal intervals in the rotation direction Rd.

Front ends 32*ba* of the protrusions 32*b* are on the side closer to the compressor impeller 18 (hereinafter, simply referred to as the downstream side). Rear ends 32*bb* of the protrusions 32*b* are on the side spaced apart from the compressor impeller 18 (hereinafter, simply referred to as the upstream side). The front ends 32*ba* of the protrusions 32*b* are spaced apart from the rear ends 32*bb* of the protrusions 32*b* in an axial direction Ad. The front ends 32*ba* of the protrusions 32*b* are provided at positions different from the rear ends 32*bb* in the rotation direction Rd. The front ends 32*ba* of the protrusions 32*b* are on the upstream side in the rotation direction Rd with respect to the rear ends 32*bb*. The protrusions 32*b* extend in the axial direction Ad and the rotation direction Rd. The extending direction of a protrusion 32*b* is tilt at an angle α with respect to the rotation direction Rd.

At a phase (angle) in the rotation direction Rd where one front end 32*ba* is positioned, two protrusions 32*b* are present on the upstream side in the axial direction Ad with respect to that front end 32*ba*. At a phase (angle) in the rotation direction Rd where one rear end 32*bb* is positioned, two protrusions 32*b* are present on the downstream side in the axial direction Ad with respect to that rear end 32*bb*. A protrusion 32*b* has an intermediate portion between the front end 32*ba* and the rear end 32*bb*. At a phase (angle) in the rotation direction Rd where one intermediate portion is positioned, one protrusion 32*b* is present on the upstream side or the downstream side in the axial direction Ad with respect to that intermediate portion. That is, the protrusions 32*b* have portions that are spaced apart from each other and face each other in the axial direction Ad. The plurality of protrusions 32*b* has portions facing each other in the axial direction Ad, and is formed over the entire circumference of the partition wall 32*a*. Two or more protrusions 32*b* are present in the axial direction Ad over the entire circumference of the partition wall 32*a*. That is, there is no phase angle where there is only one protrusion 32*b* in the axial direction Ad.

Figure 3:
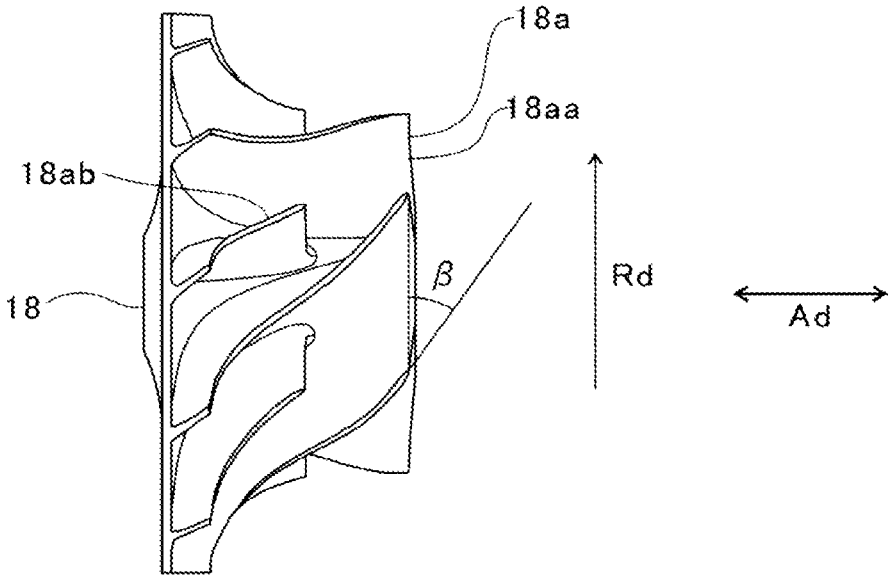
FIG. 3 is a schematic side view of a compressor impeller in the present embodiment.

FIG. 3 is a schematic side view of the compressor impeller 18 in the present embodiment. A blade 18*a* of the compressor impeller 18 has an outer diameter that decreases as the blade 18*a* extends from the downstream side (left side in FIG. 3) to the upstream side (right side in FIG. 3). A blade 18*a* of the compressor impeller 18 has the smallest outer diameter (minimum outer diameter) at the upstream end (front edge).

The blades 18*a* of the compressor impeller 18 include long blades 18*aa* and short blades 18*ab*. A long blade 18*aa* is longer in the axial direction Ad than the short blade 18*ab*. The front edge of a long blade 18*aa* is positioned on the upstream side of the main flow passage 20 with respect to the front edge of a short blade 18*ab*. The outer diameter of the front edge of a long blade 18*aa* is the smallest (minimum outer diameter) among outer diameters of the blades 18*a* of the compressor impeller 18. An extended direction (tangential line) from the front edge of the outer circumferential surface of a long blade 18*aa* is tilt toward the rotation direction Rd with respect to the axial direction Ad. The extended direction (tangential line) from the front edge of the outer circumferential surface of a long blade 18*aa* is tilt at an angle 3 with respect to the rotation direction Rd. Here, an tilt angle α of a protrusion 32*b* of the baffle 32 is smaller than the tilt angle β of a long blade 18*aa*.

In the turbocharger TC, the air may flow reverse to the upstream side of the compressor impeller 18, under operating conditions with smaller flow rate. The air flowing reverse to the upstream side of the compressor impeller 18 (hereinafter, also simply referred to as reverse flow air) travels in a direction away from the compressor impeller 18 (right side in FIG. 1) along the inner circumferential surface of the cylindrical portion 6*a*. The reverse flow air flows into a space between the inner circumferential surface of the upstream side squeeze portion 6*b* and the outer circumferential surface of the partition wall 32*a*. The protrusions 32*b* of the baffle 32 are arranged in the space between the inner circumferential surface of the upstream side squeeze portion 6*b* and the outer circumferential surface of the partition wall 32*a*. That is, the reverse flow air flows into the space on the outer circumferential surface side where the protrusions 32*b* of the baffle 32 are arranged. Since the reverse flow air flows into the space on the outer circumferential surface side of the baffle 32, the influence on the space on the inner circumferential surface side of the baffle 32 is reduced. That is, since the reverse flow air flows into the space on the outer circumferential surface side of the baffle 32, the influence on the air flowing from the upstream side to the downstream side in the space on the inner circumferential surface side of the baffle 32 (main flow passage 20) is reduced. As a result, the baffle 32 can expand the working range of the turbocharger TC, in the smaller flow rate area.

The reverse flow air is rotated in a direction tilt at the tilt angle β with respect to the rotation direction Rd.

The rotated reverse flow air flows into the space on the outer circumferential surface side where the protrusions 32*b* of the baffle 32 are arranged. Here, the tilt angle α of the protrusions 32*b* is set smaller than the tilt angle Therefore, the reverse flow air comes into contact with wall surfaces (lateral surfaces) of the protrusions 32*b*. By setting the tilt angle α to be smaller than the tilt angle it is possible to increase the contact area between the reverse flow air and the lateral walls of the protrusions 32*b* than in a case where the tilt angle α is equal to the tilt angle β. By increasing the contact area, it is possible to slow down the reverse flow air. That is, the protrusions 32*b* can reduce reverse flow of air to the upstream side of the baffle 32.

In addition, an interval of the protrusions 32*b* between a portion farthest from the compressor impeller 18 and a portion facing thereto in the axial direction Ad may be larger than an interval of the protrusions 32*b* between a portion closest to the compressor impeller 18 and a portion facing thereto in the axial direction Ad. Specifically, an interval of the protrusions 32*b* between portions facing each other in the axial direction Ad (hereinafter, also simply referred to as a facing interval) increases as the protrusion 32*b* extends in a direction away from the compressor impeller 18. By setting the facing interval of the protrusions 32*b* on the upstream side to be larger than the facing interval on the downstream side, it is possible to slow down the reverse flow air as compared to a case where the facing interval of the protrusions 32*b* is constant. That is, the protrusions 32*b* can reduce reverse flow of air to the upstream side of the baffle 32.

In addition, an interval between the inner circumferential surface of the upstream side squeeze portion 6*b* and the outer circumferential surface of the partition wall 32*a* may be set larger on the upstream side than on the downstream side. That is, the interval between the inner circumferential surface of the upstream side squeeze portion 6*b* and the outer circumferential surface of the partition wall 32*a* may be set larger on a side spaced apart from the compressor impeller 18 than on a side closer to the compressor impeller 18. As a result, a space between the inner circumferential surface of the upstream side squeeze portion 6*b* and the outer circumferential surface of the partition wall 32*a* is larger on the upstream side than on the downstream side. By setting the space on the upstream side to be larger than the space on the downstream side, it is possible to slow down the reverse flow air as compared to a case where the interval between the outer circumferential surface of the partition wall 32*a* and the inner circumferential surface of the upstream side squeeze portion 6*b* is constant. That is, the baffle 32 can reduce reverse flow of air to the upstream side of the baffle 32.

In this manner, the baffle 32 reduces the reverse flow of air to the upstream side of the baffle 32, under the operating conditions with smaller flow rate of the turbocharger TC. As a result, the baffle 32 can expand the working range of the turbocharger TC, in the smaller flow rate area.

Figure 4:
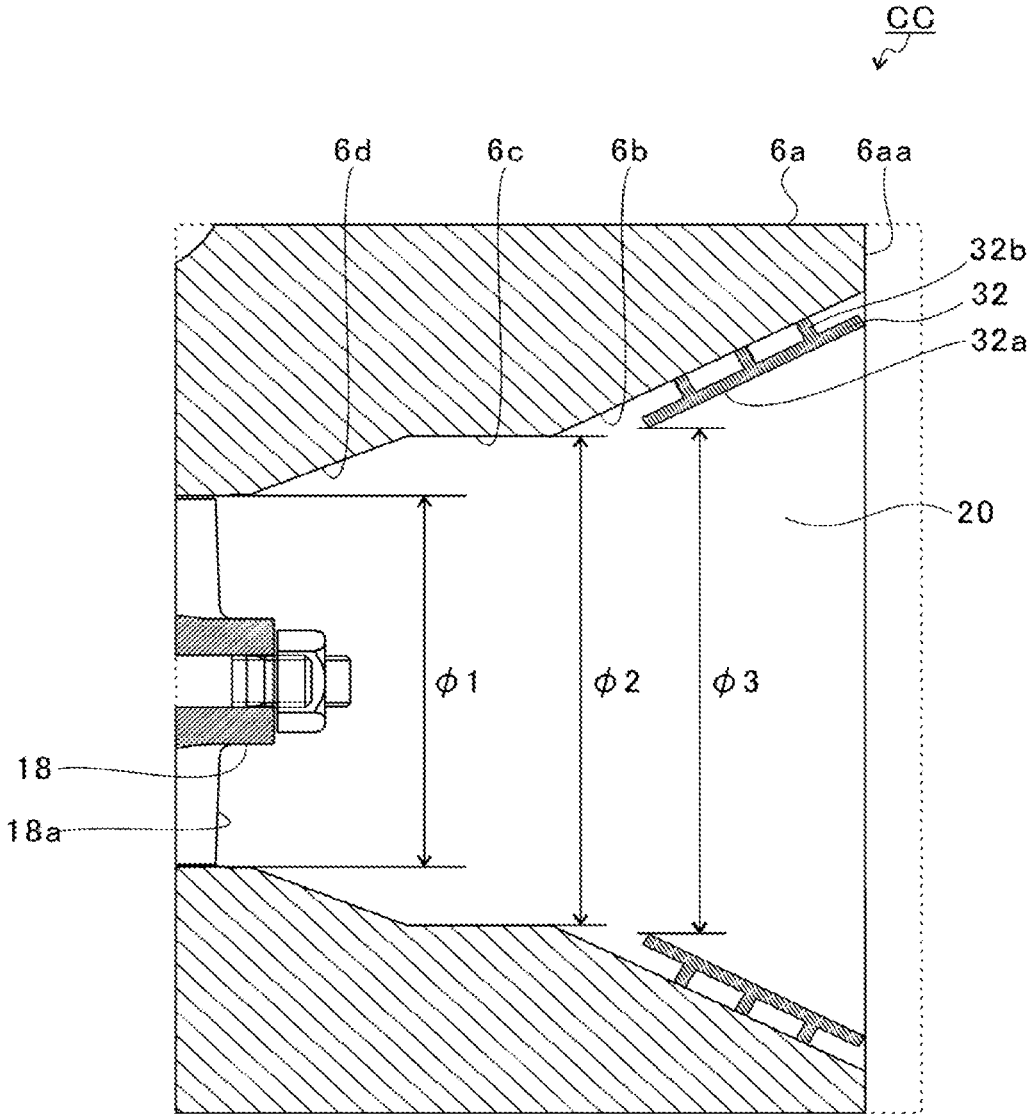
FIG. 4 is a diagram of a broken line part extracted from FIG. 1.

FIG. 4 is a diagram of a broken line part extracted from FIG. 1. A value φ1 denotes the smallest inner diameter of the downstream side squeeze portion 6*d*. The inner diameter φ1 is the inner diameter of the downstream end of the downstream side squeeze portion 6*d*. Note that the inner diameter φ1 is the smallest inner diameter of the cylindrical portion 6*a* defining the main flow passage 20. A value φ2 denotes the largest inner diameter of the downstream side squeeze portion 6*d*. The inner diameter φ2 is the inner diameter of the upstream end of the downstream side squeeze portion 6*d*.

The inner diameter φ2 is the inner diameter of the parallel portion 6*c*. The inner diameter φ2 is the smallest inner diameter of the upstream side squeeze portion 6*b*. The inner diameter φ2 is the inner diameter of the downstream end of the upstream side squeeze portion 6*b*. A value φ3 denotes the smallest inner diameter of the baffle 32. The inner diameter φ3 is the inner diameter of the downstream end (left side in FIG. 4) of the inner circumferential surface of the baffle 32.

Here, the inner diameter φ1 is smaller than the inner diameter φ2. The inner diameter φ2 is smaller than the inner diameter φ3. In other words, the smallest inner diameter φ3 of the baffle 32 is larger than the smallest inner diameter φ2 of the upstream side squeeze portion 6*b*. That is, the baffle 32 does not protrude inward in the radial direction with respect to the upstream side squeeze portion 6*b*. By attaching the baffle 32 to the tilt surface of the upstream side squeeze portion 6*b*, it is possible to make it difficult for the baffle 32 to protrude inward in the radial direction with respect to the upstream side squeeze portion 6*b*.

Note that the smallest inner diameter φ3 of the baffle 32 may be the same as the smallest inner diameter φ2 of the upstream side squeeze portion 6*b*. By attaching the baffle 32 to the tilt surface of the upstream side squeeze portion 6*b*, it is possible to set the smallest inner diameter φ3 of the baffle 32 to be larger than or equal to the smallest inner diameter φ2 of the upstream side squeeze portion 6*b*.

Note that the smallest inner diameter φ3 of the baffle 32 may be smaller than the smallest inner diameter φ2 of the upstream side squeeze portion 6*b*. However, the smallest inner diameter φ3 of the baffle 32 is larger than the smallest inner diameter φ1 of the downstream side squeeze portion 6*d*. That is, the baffle 32 does not protrude inward in the radial direction with respect to the downstream side squeeze portion 6*d*. In other words, the inner circumferential surface of the downstream side squeeze portion 6*d* protrudes inward in the radial direction of the compressor impeller 18 with respect to the inner circumferential surface of the baffle 32 (partition wall 32*a*).

In a case where the baffle 32 protrudes inward in the radial direction with respect to the downstream side squeeze portion 6*d*, the baffle 32 reduces the flow passage cross-sectional area (opening diameter) of the main flow passage 20. When the flow passage cross-sectional area (opening diameter) of the main flow passage 20 is reduced, the working range of the turbocharger TC in the larger flow rate area is reduced. Therefore, the smallest inner diameter φ3 of the baffle 32 is set larger than the smallest inner diameter φ1 of the downstream side squeeze portion 6*d*. By setting the smallest inner diameter φ3 of the baffle 32 larger than the smallest inner diameter φ1 of the downstream side squeeze portion 6*d*, it is possible to retain the working range of the turbocharger TC in the larger flow rate area.

According to the embodiment, the baffle 32 can slow down the air flowing reverse from the compressor impeller 18. As a result, the baffle 32 can shift the critical flow rate at which surging occurs to the smaller flow rate side. Furthermore, since the baffle 32 is attached to the upstream side squeeze portion 6*b*, the baffle 32 does not protrude further inward in the radial direction with respect to the upstream side squeeze portion 6*b* (and the downstream side squeeze portion 6*d*). As a result, the baffle 32 can retain the critical flow rate at which choke occurs.

(Modification)

Figure 5:
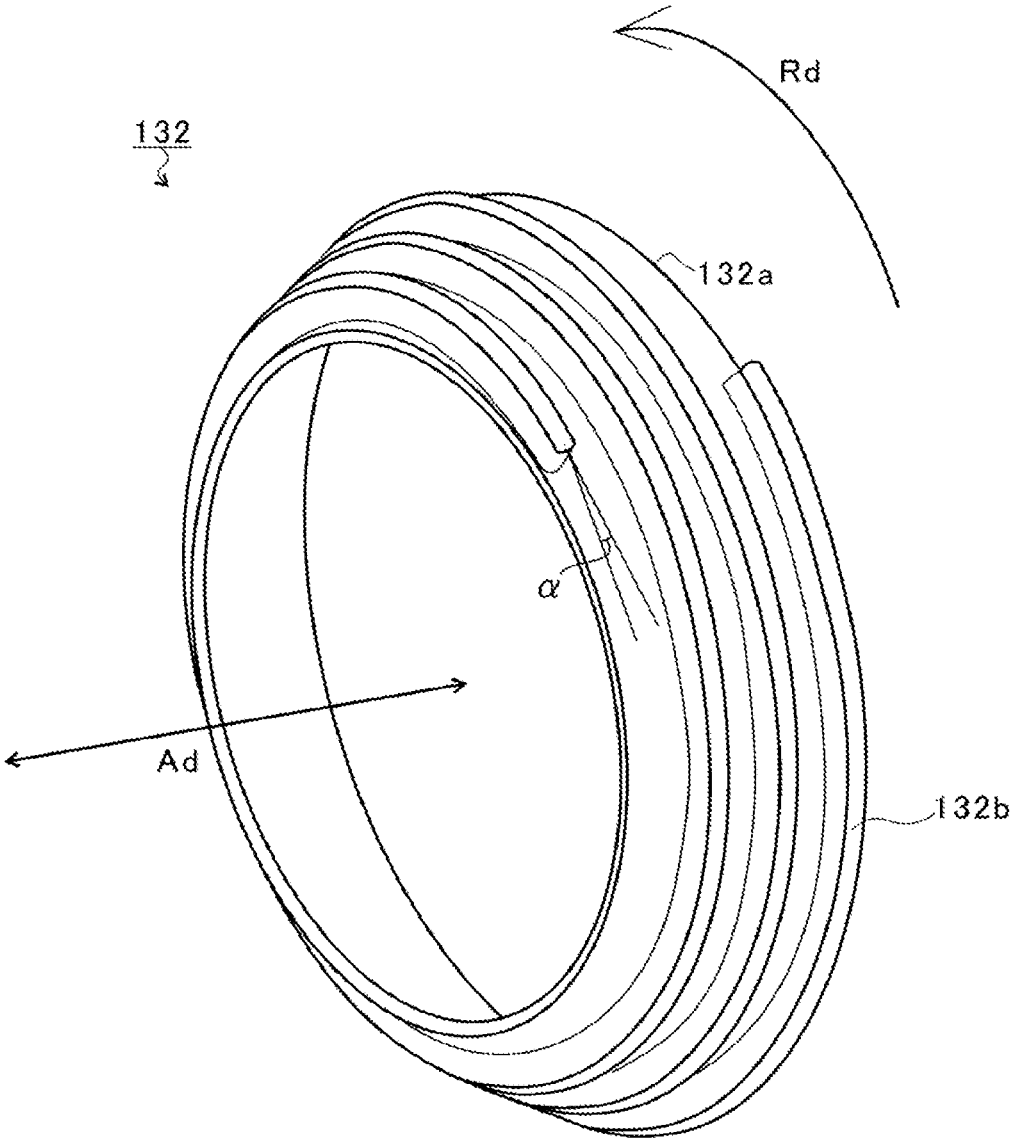
FIG. 5 is a schematic perspective view of a baffle in a modification.

FIG. 5 is a schematic perspective view of a baffle 132 in a modification. Components that are substantially the same as those of the turbocharger TC of the above embodiment are denoted by the same symbol, and the description thereof will be omitted. A turbocharger TC of the modification includes a baffle 132 instead of the baffle 32 of the above embodiment. The baffle 132 of the present modification will be described below.

The baffle 132 includes a partition wall 132*a* and a protrusion 132*b*. The partition wall 132*a* has a truncated cone shape. The partition wall 132*a* faces the inner circumferential surface of the upstream side squeeze portion 6*b*. The partition wall 132*a* is arranged with a gap from the inner circumferential surface of the upstream side squeeze portion 6*b*. The partition wall 132*a* has an outer circumferential surface that is parallel to the inner circumferential surface of the upstream side squeeze portion 6*b*. Therefore, the outer diameter of the partition wall 132*a* decreases as the partition wall 132*a* extends closer to the compressor impeller 18. However, the outer circumferential surface of the partition wall 132*a* may not be parallel to the inner circumferential surface of the upstream side squeeze portion 6*b*.

The partition wall 132*a* has an inner circumferential surface parallel to the inner circumferential surface of the upstream side squeeze portion 6*b*. Therefore, the inner diameter of the partition wall 132*a* decreases as the partition wall 132*a* extends closer to the compressor impeller 18. However, the inner circumferential surface of the partition wall 132*a* may not be parallel to the inner circumferential surface of the upstream side squeeze portion 6*b*.

An interval between the inner circumferential surface of the upstream side squeeze portion 6*b* and the outer circumferential surface of the partition wall 132*a* may be set larger on the upstream side than on the downstream side. As a result, a space between the inner circumferential surface of the upstream side squeeze portion 6*b* and the outer circumferential surface of the partition wall 132*a* is larger on the upstream side than on the downstream side. By setting the space on the upstream side to be larger than the space on the downstream side, it is possible to slow down the air flowing reverse from the compressor impeller 18 as compared to a case where the interval between the outer circumferential surface of the partition wall 132*a* and the inner circumferential surface of the upstream side squeeze portion 6*b* is constant. That is, the baffle 132 can reduce reverse flow of air to the upstream side of the baffle 132.

At least one protrusion 132*b* is formed on the outer circumferential surface of the partition wall 132*a*. The protrusion 132*b* protrudes from the outer circumferential surface of the partition wall 132*a* in a direction approaching the inner circumferential surface of the upstream side squeeze portion 6*b*. In this modification, the protrusion 132*b* protrudes in a direction perpendicular to the outer circumferential surface of the partition wall 132*a*. However, the protrusion 132*b* may not protrude in the direction perpendicular to the outer circumferential surface of the partition wall 132*a*. For example, the protrusion 132*b* may protrude from the outer circumferential surface of the partition wall 132*a* in the radial direction of the compressor impeller 18. The protrusion 132*b* is in contact with the inner circumferential surface of the upstream side squeeze portion 6*b*. However, the protrusion 132*b* may not be in contact with the inner circumferential surface of the upstream side squeeze portion 6*b*.

In this modification, the protrusion 132*b* has a spiral shape. The protrusion 132*b* extends in the axial direction Ad and the rotation direction Rd. The extending direction of the protrusion 132*b* is tilt at an angle $\alpha$ with respect to the rotation direction Rd. The tilt angle $\alpha$ of the protrusion 132*b* of this modification is smaller than the tilt angle $\alpha$ of the protrusion 32*b* of the above embodiment. In this modification, the protrusion 132*b* has a length that makes three rounds on the outer circumferential surface of the partition wall 132*a*. However, the length of the protrusion 132*b* in the rotation direction Rd is only required to be at least one-round length of the outer circumferential surface of the partition wall 132*a*. That is, the protrusion 132*b* extends for one or more rounds in the rotation direction Rd of the compressor impeller 18. The protrusion 132*b* has portions that are spaced apart from each other and face each other in the axial direction Ad. The protrusion 132*b* has portions facing each other in the axial direction Ad, and is formed over the entire circumference of the partition wall 132*a*.

In the present modification, a single protrusion 132*b* is formed on the outer circumferential surface of the partition wall 132*a*. However, a plurality of protrusions 132*b* may be formed on the outer circumferential surface of the partition wall 132*a*. In this case, at least one protrusion 132*b* extends one or more rounds in the rotation direction Rd of the compressor impeller 18.

In the present modification, the facing interval of the protrusion 132*b* in the axial direction Ad is constant. However, the facing interval of the protrusion 132*b* in the axial direction Ad may not be constant. For example, an interval of the protrusion 132*b* between a portion farthest from the compressor impeller 18 and a portion facing thereto in the axial direction Ad may be larger than an interval of the protrusion 132*b* between a portion closest to the compressor impeller 18 and a portion facing thereto in the axial direction Ad. Specifically, the protrusion 132*b* may have a facing interval in the axial direction Ad that increases as the protrusion 132*b* extends in a direction away from the compressor impeller 18.

By setting the facing interval on the upstream side of the protrusion 132*b* to be larger than that on the downstream side, it is possible to slow down the air that flows reverse from the compressor impeller 18 as compared with a case where the facing interval of the protrusion 132*b* is constant. That is, the protrusion 132*b* can reduce reverse flow of air to the upstream side of the baffle 132.

According to the modification, similar effects to those of the above embodiment can be obtained. Furthermore, the baffle 132 of the present modification can increase the contact area between the air flowing reverse from the compressor impeller 18 and the lateral walls of the protrusion 132*b* as compared to that of the baffle 32 of the above embodiment.

Therefore, according to the present modification, the air that flows reverse from the compressor impeller 18 can be slow down more than in the above embodiment. As a result, in this modification, the critical flow rate at which surging occurs can be shifted further to the smaller flow rate side than in the above embodiment.

In addition, the protrusion 132*b* of the baffle 132 of the present modification is fewer than those of the baffle 32 of the above embodiment. Therefore, the baffle 132 of the present modification can reduce the pressure loss due to a separation vortex generated when the air passes through the protrusion 132*b*, as compared with the baffle 32 of the above-described embodiment. That is, the baffle 132 of the present modification can further reduce the pressure loss when the air flows from the upstream side to the downstream side as compared with the baffle 32 of the above-described embodiment.

Although the embodiments of the present disclosure have been described with reference to the accompanying drawings, it is understood that the present disclosure is not limited to the above embodiments. It is obvious that a person skilled in the art can conceive of various modifications or variations within the scope described in the claims, and it is understood that they are also within the technical scope of the present disclosure.

For example, the baffle 32 of the above embodiment and the baffle 132 of the above modification may be combined. That is, a protrusion 32*b* and a protrusion 132*b* may be both formed on the outer circumferential surface of the baffle 32.

In the above-described embodiment and modification, the examples have been described in which the baffles 32 and 132 have the protrusions 32*b* and 132*b*, respectively. However, the present invention is not limited thereto, and the protrusions 32*b* and 132*b* may be formed on the inner circumferential surface of the upstream side squeeze portion 6*b*. Moreover, the protrusions 32*b* and 132*b* may include a protrusion formed on the inner circumferential surface of the upstream side squeeze portion 6*b* and a protrusion formed on the outer circumferential surfaces of the baffles 32 and 132, respectively. That is, the protrusions 32*b* and 132*b* may protrude from at least one of the inner circumferential surface of the upstream side squeeze portion 6*b* or the outer circumferential surface of the partition wall 32*a* or 132*a*. Furthermore, the protrusions 32*b* and 132*b* may protrude in a direction in which the inner circumferential surface of the upstream side squeeze portion 6*b* and the outer circumferential surface of the partition wall 32*a* are arranged close to each other.

In the above-described embodiment and modification, the example in which the baffles 32 and 132 are provided to the upstream side squeeze portion 6*b* has been described. However, the present invention is not limited thereto, and the baffles 32 and 132 may be provided to the downstream side squeeze portion 6*d*.

INDUSTRIAL APPLICABILITY

The present disclosure is applicable to a centrifugal compressor.

What is claimed is:

1. A centrifugal compressor comprising:

a compressor impeller;

a main flow passage formed on a front side of the compressor impeller;

a squeeze portion provided in the main flow passage, the squeeze portion having a flow passage cross-sectional area that decreases as the squeeze portion extends closer to the compressor impeller;

a partition wall facing an inner circumferential surface of the squeeze portion and arranged with a gap from the inner circumferential surface of the squeeze portion; and a protrusion protruding from at least one of the inner circumferential surface of the squeeze portion or an outer circumferential surface of the partition wall.

2. The centrifugal compressor according to claim 1, wherein the protrusion includes portions that are spaced apart from each other and face each other in an axial direction of the compressor impeller.

3. The centrifugal compressor according to claim 1, wherein the protrusion extends for one or more rounds in a rotation direction of the compressor impeller.

4. The centrifugal compressor according to claim 2, wherein the protrusion extends for one or more rounds in a rotation direction of the compressor impeller.

5. The centrifugal compressor according to claim 1, wherein the protrusion includes portions spaced apart from each other and facing each other in an axial direction of the compressor impeller, and an interval of the protrusion between a portion farthest from the compressor impeller and a portion facing thereto in the axial direction is larger than an interval of the protrusion between a portion closest to the compressor impeller and a portion facing thereto in the axial direction.

6. The centrifugal compressor according to claim 2, wherein the protrusion includes portions spaced apart from each other and facing each other in an axial direction of the compressor impeller, and an interval of the protrusion between a portion farthest from the compressor impeller and a portion facing thereto in the axial direction is larger than an interval of the protrusion between a portion closest to the compressor impeller and a portion facing thereto in the axial direction.

7. The centrifugal compressor according to claim 3, wherein the protrusion includes portions spaced apart from each other and facing each other in an axial direction of the compressor impeller, and an interval of the protrusion between a portion farthest from the compressor impeller and a portion facing thereto in the axial direction is larger than an interval of the protrusion between a portion closest to the compressor impeller and a portion facing thereto in the axial direction.

8. The centrifugal compressor according to claim 4, wherein the protrusion includes portions spaced apart from each other and facing each other in an axial direction of the compressor impeller, and an interval of the protrusion between a portion farthest from the compressor impeller and a portion facing thereto in the axial direction is larger than an interval of the protrusion between a portion closest to the compressor impeller and a portion facing thereto in the axial direction.

9. The centrifugal compressor according to claim 1, wherein an interval between the inner circumferential surface of the squeeze portion and the outer circumferential surface of the partition wall is larger on a side spaced apart from the compressor impeller than on a side closer to the compressor impeller.

10. The centrifugal compressor according to claim 2, wherein an interval between the inner circumferential surface of the squeeze portion and the outer circumferential surface of the partition wall is larger on a side spaced apart from the compressor impeller than on a side closer to the compressor impeller.

11. The centrifugal compressor according to claim 3, wherein an interval between the inner circumferential surface of the squeeze portion and the outer circumferential surface of the partition wall is larger on a side spaced apart from the compressor impeller than on a side closer to the compressor impeller.

12. The centrifugal compressor according to claim 4, wherein an interval between the inner circumferential surface of the squeeze portion and the outer circumferential surface of the partition wall is larger on a side spaced apart from the compressor impeller than on a side closer to the compressor impeller.

13. The centrifugal compressor according to claim 5, wherein an interval between the inner circumferential surface of the squeeze portion and the outer circumferential surface of the partition wall is larger on a side spaced apart from the compressor impeller than on a side closer to the compressor impeller.

14. The centrifugal compressor according to claim 6, wherein an interval between the inner circumferential surface of the squeeze portion and the outer circumferential surface of the partition wall is larger on a side spaced apart from the compressor impeller than on a side closer to the compressor impeller.

15. The centrifugal compressor according to claim 7, wherein an interval between the inner circumferential surface of the squeeze portion and the outer circumferential surface of the partition wall is larger on a side spaced apart from the compressor impeller than on a side closer to the compressor impeller.

16. The centrifugal compressor according to claim 8, wherein an interval between the inner circumferential surface of the squeeze portion and the outer circumferential surface of the partition wall is larger on a side spaced apart from the compressor impeller than on a side closer to the compressor impeller.

17. The centrifugal compressor according to claim 1, comprising:

a second squeeze portion that is provided in the main flow passage, positioned closer to the compressor impeller than the squeeze portion, and has an inner circumferential surface protruding inward in a radial direction of the compressor impeller with respect to an inner circumferential surface of the partition wall.

* * * * *